US007292234B2

(12) United States Patent
Kitahara

(10) Patent No.: US 7,292,234 B2
(45) Date of Patent: Nov. 6, 2007

(54) ORGANIC EL PANEL DRIVE CIRCUIT AND ORGANIC EL DISPLAY DEVICE USING THE SAME DRIVE CIRCUIT

(75) Inventor: Shinji Kitahara, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 704 days.

(21) Appl. No.: 10/855,375

(22) Filed: May 28, 2004

(65) Prior Publication Data

US 2005/0001795 A1 Jan. 6, 2005

(30) Foreign Application Priority Data

Jun. 6, 2003 (JP) ..... 2003-161942

(51) Int. Cl.
*G09G 3/30* (2006.01)

(52) U.S. Cl. ..... 345/204; 345/76; 345/84; 345/205; 345/690; 315/169.3; 340/825.8

(58) Field of Classification Search ..... 345/76, 345/77, 84, 92, 94, 100, 204, 205, 690; 315/169.3; 340/825.8

See application file for complete search history.

(56) References Cited

U.S. PATENT DOCUMENTS 5,990,629 A * 11/1999 Yamada et al. ..... 315/169.3
2003/0103022 A1* 6/2003 Noguchi et al. ..... 345/77
2003/0151616 A1* 8/2003 Morita ..... 345/690

FOREIGN PATENT DOCUMENTS

JP 9-232074 9/1997
JP 2001-143867 5/2001

* cited by examiner

*Primary Examiner*—Bipin Shalwala
*Assistant Examiner*—Vincent E. Kovalick
(74) *Attorney, Agent, or Firm*—Mattingly, Stanger, Malur & Brundidge, P.C.

(57) ABSTRACT

A resetting period of organic EL elements is divided to a discharge period for discharging residual charges of the organic EL elements and a precharge period for pre-charging the organic EL elements to predetermined potentials. First switch circuits provided for each of R (red), G (green) and B (blue) display colors are turned ON in the discharge period to discharge residual charges of the organic EL elements and second switch circuits provided for each of R, G and B display colors are turned ON in the precharge period to precharge the EL elements to a precharge potential lower than a light emission voltage of the organic EL elements. Values of finally set precharge voltages for R, G and B display colors are made different from each other.

24 Claims, 3 Drawing Sheets

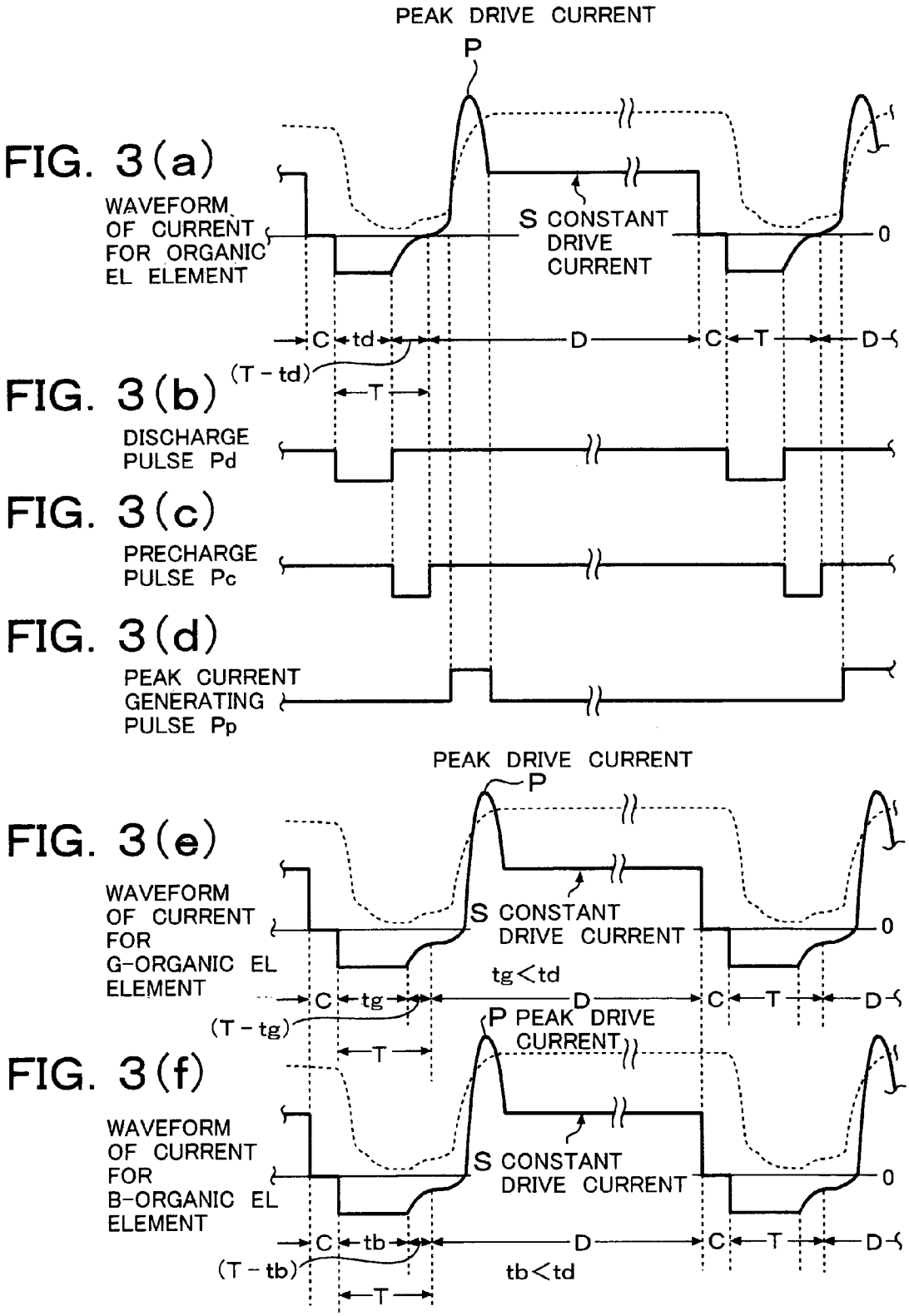
FIG. 3(a)
PEAK DRIVE CURRENT
P
WAVEFORM OF CURRENT FOR ORGANIC EL ELEMENT
S CONSTANT DRIVE CURRENT
0
C
td
D
C
T
D
(T - td)
T
FIG. 3(b)
DISCHARGE PULSE Pd
FIG. 3(c)
PRECHARGE PULSE Pc
FIG. 3(d)
PEAK CURRENT GENERATING PULSE Pp
FIG. 3(e)
PEAK DRIVE CURRENT
P
WAVEFORM OF CURRENT FOR G-ORGANIC EL ELEMENT
S CONSTANT DRIVE CURRENT
0
tg<td
C
tg
D
C
T
D
(T - tg)
T
FIG. 3(f)
P PEAK DRIVE CURRENT
WAVEFORM OF CURRENT FOR B-ORGANIC EL ELEMENT
S CONSTANT DRIVE CURRENT
0
C
tb
D
C
T
D
(T - tb)
tb<td
T

ORGANIC EL PANEL DRIVE CIRCUIT AND ORGANIC EL DISPLAY DEVICE USING THE SAME DRIVE CIRCUIT

BACKGROUND OF THE INVENTION

1. Field of the Invention

The present invention relates to an EL (electro luminescent) element drive circuit and an organic EL display device using the same drive circuit and, in particular, the present invention relates to an organic EL display device suitable for high luminance color display, with which display luminance of organic EL elements can be improved and white balance on a display screen of an electronic device such as a portable telephone set or a PHS, etc., can be easily regulated by regulating luminous intensities of R (red), G (green) and B (blue) display colors even when dynamic range of regulation of reference current value of each of R, G and B colors is small.

2. Description of the Prior Art

An organic EL display panel of an organic EL display device, which is mounted on a portable telephone set, a PHS, a DVD player or a PDA (personal digital assistance) and includes 396 (132×3) terminal pins for column lines and 162 terminal pins for row lines, has been proposed and the number of column lines and the number of row lines of such organic EL display panel tend to be further increased.

An output stage of a current drive circuit of such organic EL display panel includes an output circuit constructed with, for example, current-mirror circuits, which are provided correspondingly to respective terminal pins of the panel, regardless of the type of drive current, the passive matrix type or the active matrix type. Incidentally, in a case of the passive matrix type current-drive system, a drive current having a peak value is utilized in order to emit light earlier by initially charging an organic EL element having capacitive load characteristics, at a start time of light emission period. Particularly, in order to prevent variation of luminous intensities of R, G and B display colors for the passive matrix type, a reset period is provided after the current drive period to discharge residual charge of an organic EL element to be current-driven next to a predetermined constant voltage (for example, several volts) or to ground potential. In this manner, the drive current waveform and the peak current value and waveform thereof are not changed when the organic EL element is current-driven by the peak current generated after the resetting.

Incidentally, JPH9-232074A discloses a drive circuit for organic EL elements, in which the organic EL elements arranged in a matrix are current-driven and a terminal voltage of each organic EL element is reset by grounding an anode and a cathode of the organic EL element. Further, JP2001-143867A discloses a technique with which power consumption of an organic EL display device is reduced by current-driving organic EL elements with using DC-DC converters.

One of the problems of a conventional organic EL display device is that the predetermined reset period is necessary and luminous intensity is degraded since light emitting period is shortened when scan frequency is increased. Particularly, the residual charge must be discharged to the predetermined constant voltage after light emission of the organic EL element is ended and, in order to match the reset period to the longest discharge period of one of R, G and B display colors, the reset period becomes long by all means. On the other hand, when the resetting of the organic EL element is performed by discharging residual charge thereof to ground, it is possible to shorten the discharge period.

However, a time period in which the potential of the organic EL elements must be increased from ground potential to the peak current becomes long. Therefore, the substantial light emission period of the organic EL element is shortened, resulting in degradation of luminous intensities thereof.

Another problem of the conventional organic EL display device is that, when the voltage drive is used to drive terminal pins thereof as in a liquid crystal display device, a display control becomes difficult and luminance variation becomes conspicuous due to difference in luminous sensitivity between R, G and B display colors. For this reason, the organic EL display device has to be current-driven. However, even when the current drive is employed, ratio of light emission efficiency for drive currents of R. G and B colors is, for example, R:G:B=6:11:10, which depends upon luminescent materials of the organic EL elements.

In view of this, it is necessary, in a current-drive circuit of an organic EL color display device, that white balance is obtained on a display screen thereof by regulating luminous intensity of each of R, G and B colors according to luminescent materials of EL elements for respective R, G and B colors. In order to realize such white balance regulation, regulation circuits for regulating luminous intensities of respective R, G and B colors on the display screen are provided.

It is usual, in the conventional organic EL display device, that the current-drive circuit of the organic EL display device generates drive currents for driving organic EL elements, which are connected to respective column line pins, by amplifying reference currents for R, G and B display colors and that the regulation of the drive currents for obtaining white balance is performed by regulating the reference currents for respective R, G and B display colors.

In order to regulate the reference currents for respective R, G and B colors, each of reference current generator circuits of a conventional drive current regulator circuit includes a D/A converter circuit of, for example, 4 bits and the reference currents for respective R, G and B display colors are regulated by setting a predetermined bit data for each of R, G and B display colors at 5 μA intervals within a range, for example, from 30 μA to 75 μA. With the fact that various organic EL materials have been developed recently, the luminance regulation for realizing white balance, which is realizable by the D/A converter circuits, is not enough since the dynamic range of regulation is as rough as 4 bits.

However, if the number of bits of the D/A converter circuit for luminance regulation of each of R, G and B display colors is increased to 6 to 8 bits, the size of the current drive circuit becomes large since the D/A converter circuits must be provided for respective R, G and B display colors, and, therefore, it becomes difficult to integrate the current drive circuit in one chip. Further, it is difficult to respond to the request of miniaturization of the display device portion.

SUMMARY OF THE INVENTION

A first object of the present invention is to provide an organic EL panel drive circuit capable of improving display luminance by shortening a resetting period required to reset organic EL elements to a constant voltage and an organic EL display device using the same organic EL panel drive circuit.

A second object of the present invention is to provide an organic EL panel drive circuit, with which, in order to obtain white balance, a precise regulation of luminous intensities of R, G and B display colors is possible even when dynamic ranges of regulation of reference current values for R, G and B display colors are small, and an organic EL display device using the same organic EL panel drive circuit.

In order to achieve the first object, the organic EL drive circuit for current-driving organic EL elements comprises at least three first switch circuits provided correspondingly to terminal pins of an organic EL display panel for respective R, G and B display colors and connected between the terminal pins and a first potential line, for discharging residual charges of organic EL elements having anodes connected to the respective terminal pins, at least three second switch circuits provided correspondingly to the terminal pins for respective R, 0 and B display colors and connected between the terminal pins and a second potential line, for setting the anodes of the organic EL elements to predetermined potentials lower than light emission voltages of the organic EL elements and a pulse generator circuit for generating pulses for turning the first switch circuits ON and then turning the first switch circuits OFF and then turning the second switch circuits ON during a precharge period within a predetermined time period, respectively.

In order to achieve the second object of the present invention, the pulses generated by the pulse generator circuit have widths, with which the predetermined potentials for at least two of R, G and B display colors are made different to allow luminance regulation of R, G and B display colors necessary to obtain white balance.

In an embodiment of the present invention, the resetting period is divided to a discharge period and a precharge period and the first switch circuits are made ON in the discharge period and the second switch circuits are made ON in the precharge period, so that the predetermined potentials lower than the light emitting voltage of the organic EL elements are set in the organic EL elements after the residual charges of the organic EL elements for R, G and B display colors are discharged by grounding them. As a result, the potential difference resulting from the discharge of residual charges of the organic EL elements becomes larger than that in the case of the resetting of the organic EL element to the constant voltage and residual charges of the organic EL elements are removed rapidly within a short time. Since the precharge of the organic EL element from ground potential to the predetermined voltage, which is lower than the light emission voltage of the organic EL element, is as low as several voltages, a time required to precharge the organic EL element from ground potential to the predetermined voltage is short enough. As a result, the resetting time period, which is a sum of the discharge period and the precharge period, becomes short.

In more detail, as shown in FIG. 3(*a*), a waveform of a current for driving the organic EL element connected to each of column pins of the organic EL drive circuit includes a peak P starting from the predetermined voltage lower than the pre-charged voltage at which the organic EL element can emit light, similarly to the conventional drive circuit. In the case shown in FIG. 3(*a*), the predetermined voltage is ground potential, that is, 0 volt.

Therefore, the discharge and then the precharge are performed for the anode of each organic EL element before the drive current having waveform shown in FIG. 3(*a*) is generated. The sum of the discharge period td and the precharge period is the resetting period T for resetting the organic EL element to the constant voltage, as shown in FIG. 3(*a*). The organic EL element enters into a display period D after the time period T. The peak drive current P is generated at the start of the display period D and then a constant drive current S is generated. Incidentally, a switching of scan line on a row side is performed in a time period C.

Incidentally, the sum of the time period C and the resetting period T is a reset time period correspondingly to a retrace period of a horizontal scan. The sectioning of the display period D and the reset time period is performed by a timing control pulse (a reset control pulse) having a period (corresponding to a horizontal scan frequency) corresponding to (display period D+reset time period).

As mentioned, the resetting period T is the sum of the discharge period td and the precharge period (T−td). In the discharge period td, the column side pin of the organic EL element is grounded by a discharge pulse Pd and, in the precharge period (T−td), the anodes of the organic EL elements are set to a constant voltage VPR by a precharge pulse PC, as shown in FIG. 3(*b*) and FIG. 3(*c*). The drive current is generated in a next display period D after the resetting period T, with the anodes of the organic EL elements being set to the constant voltage VPR.

In an initial stage of the display period D, the peak current generating pulse Pp shown in FIG. 3(*d*) is generated. The peak current P is produced by the pulse by the pulse Pp and supplied to the anodes of the organic EL elements.

Incidentally, cathodes of the organic EL elements are scanned by a row side scan circuit to ground the cathodes of the organic EL elements for one horizontal line to be scanned. In this row side scan, row lines, which are not to be scanned, are usually set to H (high) level to reverse-bias the organic EL elements connected thereto.

As a result, it is possible to shorten the resetting period T to thereby elongate a light emitting period. Therefore, according to the present invention, it is possible to improve luminous intensities of R, G and B display colors and to make the display device suitable for high speed display scan.

Incidentally, by dividing the resetting period T to the discharge period and the precharge period for every display color and performing the discharge and precharge for every display color, it is possible to make the resetting period shorter compared with the conventional current-drive system of the organic EL elements, in which the current drive is started after the organic EL elements are reset to the constant voltage or the organic EL elements are grounded.

In another embodiment of the present invention, the discharge period and the precharge period for every display color are separated from each other and the precharge voltages for respective R, G and B display colors are set respectively.

That is, the discharge periods for R, G and B display colors are made different to separately charge the organic EL elements in the precharge periods (T−td) for respective R, G and B colors. Therefore, the final precharge voltages for the respective R, G and B display colors are set independently. Dotted lines in FIG. 3(*a*), FIG. 3(*e*) and FIG. 3(*f*) show drive voltage waveforms, which correspond to the drive current waveforms, respectively.

In more detail, the precharge period (T−td) of the organic EL elements for R display color, whose light emitting efficiency is low, is provided by using the conventional precharge pulse Pc shown in FIG. 3(*c*). Therefore, the organic EL elements enter into the display period D after the anode terminals of the organic EL elements are set to the constant voltage VPR and the organic EL elements for R display color are driven by the predetermined peak currents. As to the drive of the organic EL elements for G or B display color, whose light emitting efficiency is higher than that for R display color, the precharge is performed for the period (T−tg) or (T−tb) by precharge pulse Pcg or Pcb, with the precharge period tg or tb being longer than td, after tg or tb, as shown in FIG. 3(*e*) and FIG. 3(*f*).

As a result, the drive current waveforms for driving the organic EL elements for G and B display colors become as shown in FIG. 3(*e*) and FIG. 3(*f*), respectively, and each precharge voltage becomes lower than the constant voltage VPR. Therefore, the rising edge of the peak current P of the drive current for G or B display color is delayed from that for R display color and the width of the peak current for G or B display color becomes shorter than that for R display color. Consequently, the light emission period is shortened correspondingly to the shortness of the peak current period. Therefore, when the light emission efficiency of the organic EL elements for G or B display color is higher than that for R display color, luminous intensity of G or R color is lowered and that the light emission intensity of the organic EL element for G or B color can be made closer to that for R display color.

In view of this fact, white balance of R, G and B display colors can be regulated precisely by regulating the precharge voltages for respective R, G and B display colors even when dynamic ranges of regulation of the reference currents for R, G and B display colors are small.

Incidentally, since a difference in light emission efficiency between G and B display colors is small, the regulation of the precharge voltages for G and B display colors may be made identical. Further, depending upon luminescent materials to be developed in the future, there may be cases where the difference of light emission efficiencies of the organic EL elements for R, G and B display colors may be made larger. In such case, according to the present invention, it is enough that the pulse generator circuits generate pulses having different widths with which the predetermined potential for at least two of R, G and B display colors are made different for realizing white balance of R, G and B display colors.

BRIEF DESCRIPTION OF THE DRAWINGS

FIG. 3(*a*) to FIG. 3(*f*) show waveforms of current for driving terminal pins of the organic EL panel.

DETAILED DESCRIPTION OF THE PREFERRED EMBODIMENTS

Figure 2:
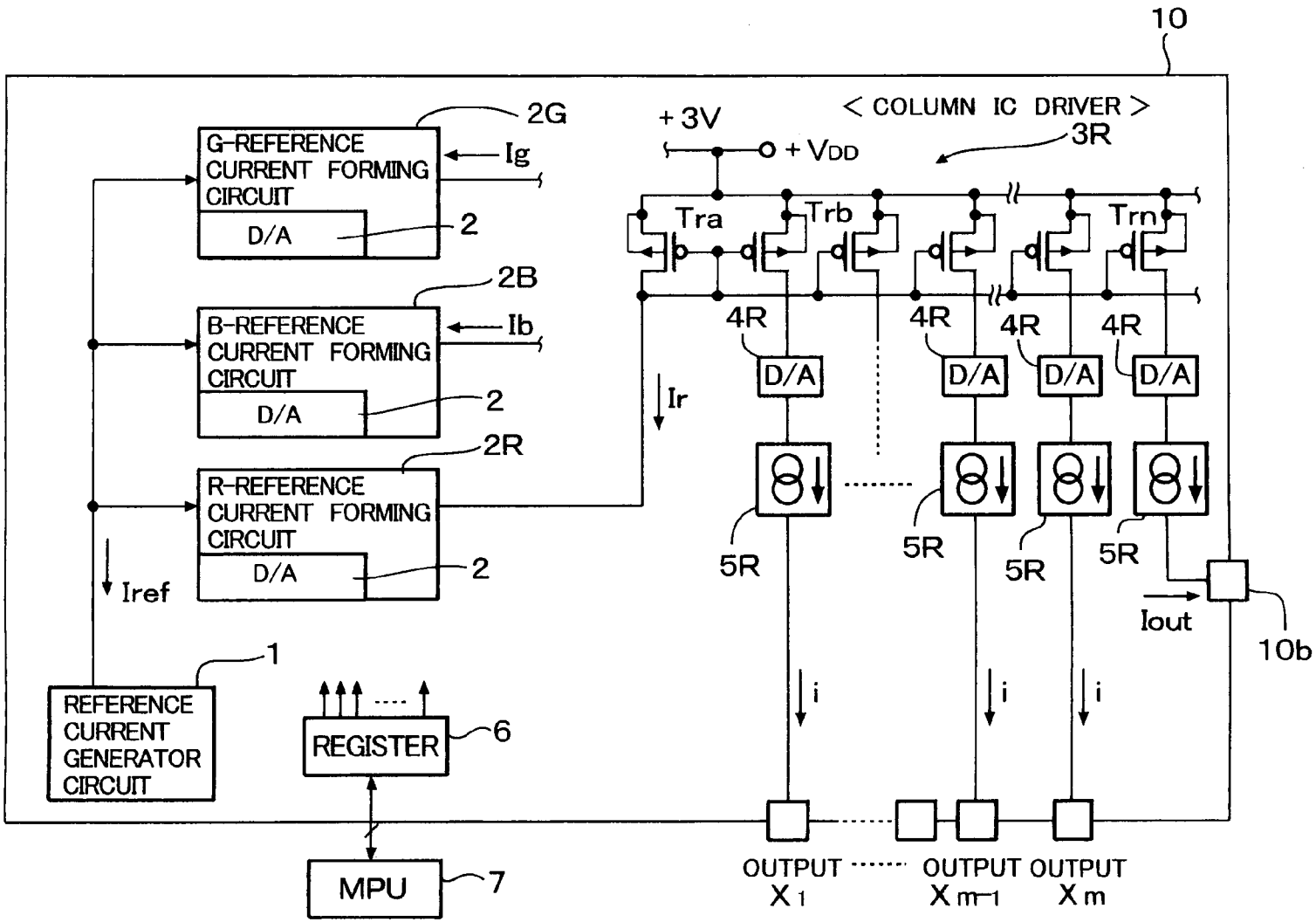
FIG. 2 is a block circuit diagram of a column driver of the organic EL panel shown in FIG. 1.

A column driver 10 shown in FIG. 2 is formed as an column IC chip functioning as an organic EL drive circuit of an organic EL panel. The column driver 10 includes a reference current generator circuit 1, a reference current forming circuit (R-reference current forming circuit) 2R provided for R (red) display color, a reference current forming circuit (G-reference current forming circuit) 2G provided for G (green) display color and a reference current forming circuit (B-reference current forming circuit) 2B provided for B (blue) display color.

Each of the reference current forming circuits 2R, 2G and 2B includes a current mirror circuit provided as an input, stage of the reference current forming circuit. The current mirror circuits of the reference current forming circuits 2R, 2G and 2B receive a reference current Iref generated by the reference current generator circuit 1 and form reference currents Ir, Ig and Ib corresponding to respective R, G and B display colors. The column IC driver 10 further includes current mirror circuits 3R, 3G and 3B provided correspondingly to respective R, G and B display colors. The current mirror circuits 3R, 3G and 3B function as reference current distributors. Each of the current mirror circuits 3R, 3G and 3B includes an input side transistor, which is driven by one of the reference currents Ir, Ig and Ib, and a plurality of output side transistors, which distribute the reference current to respective terminal pins.

Incidentally, since the current mirror circuit 3G connected to the reference current forming circuit 2G and the current mirror circuit 3B connected to the reference current forming circuit 2B are identical to the current mirror circuit 3R connected to the reference current forming circuit 2R, the current mirrors circuits 3G and 3B for respective G and B display colors are not shown in FIG. 2 and a construction and operation of only the current mirror circuit 3R for R display color will be described.

Further, each of the reference current forming circuits 2R, 2G and 2B includes a D/A converter circuit 2 of several bits, 4 bits in this embodiment, and, in order to regulate white balance, values of the reference drive currents Ir, Ig and Ib of the organic EL elements for R, G and B display colors are regulated on the basis of data set in the respective D/A converter circuits 2. The 4-bit data are externally supplied to an MPU 7 as input data and set in the respective D/A converters 2 from the MPU 7 through registers (not shown).

The reference current forming circuit 2R is driven by the reference current Iref generated by the reference current generator circuit 1 to form the reference drive current Ir of the organic EL elements for R display color. That is, the input side transistor Tra of the current mirror circuit 3R is driven by the reference current Iref to form the reference drive current Ir at the output side transistors Trb to Trn, which are P channel MOS FETs in this embodiment and are current-mirror connected to the input side transistor Tra. Sources of the output side transistors Trb to Trn are connected to a power source line +VDD (=+3V).

Drains of the transistors Trb to Trn are connected to respective D/A converter circuits 4R. The reference drive currents Ir from the drains of the transistors Trb to Trn drive the respective D/A converter circuits 4R. Incidentally, the reference current forming circuits 3G and 3B generate the reference drive currents Ig and Ib, respectively.

In response to the display data supplied from the MPU 7 through the register 6, each D/A converter circuit 4R generates a drive current i correspondingly to luminous intensity at every moment by amplifying the reference drive current Ir generated by the reference current forming circuit 2R. Output stage current sources 5R connected to the respective D/A converter circuits 4R are driven by the drive currents i. The output stage current sources 5R each being constructed with a current mirror circuit (FIG. 1) having a pair of transistors output the drive currents i to the anodes of the organic EL elements for R display color through column side output terminals X1 to Xm for R display color.

The drain of the last stage transistor Trn of the current mirror circuit 3R is connected to the D/A converter circuit 4R related thereto to drive the latter. That is, the D/A converter circuit 4R drives the output stage current source 5R according to the display data and the output stage current source 5R generates an output current Iout, which is supplied externally from an external output terminal 10*b* of the IC chip. The output current Iout is supplied to a column IC driver, which is provided in a next stage and connected to a monitor current for generating a similar drive current. The monitor current may be outputted from one of the output stage current sources provided on the G or B color side.

Figure 1:
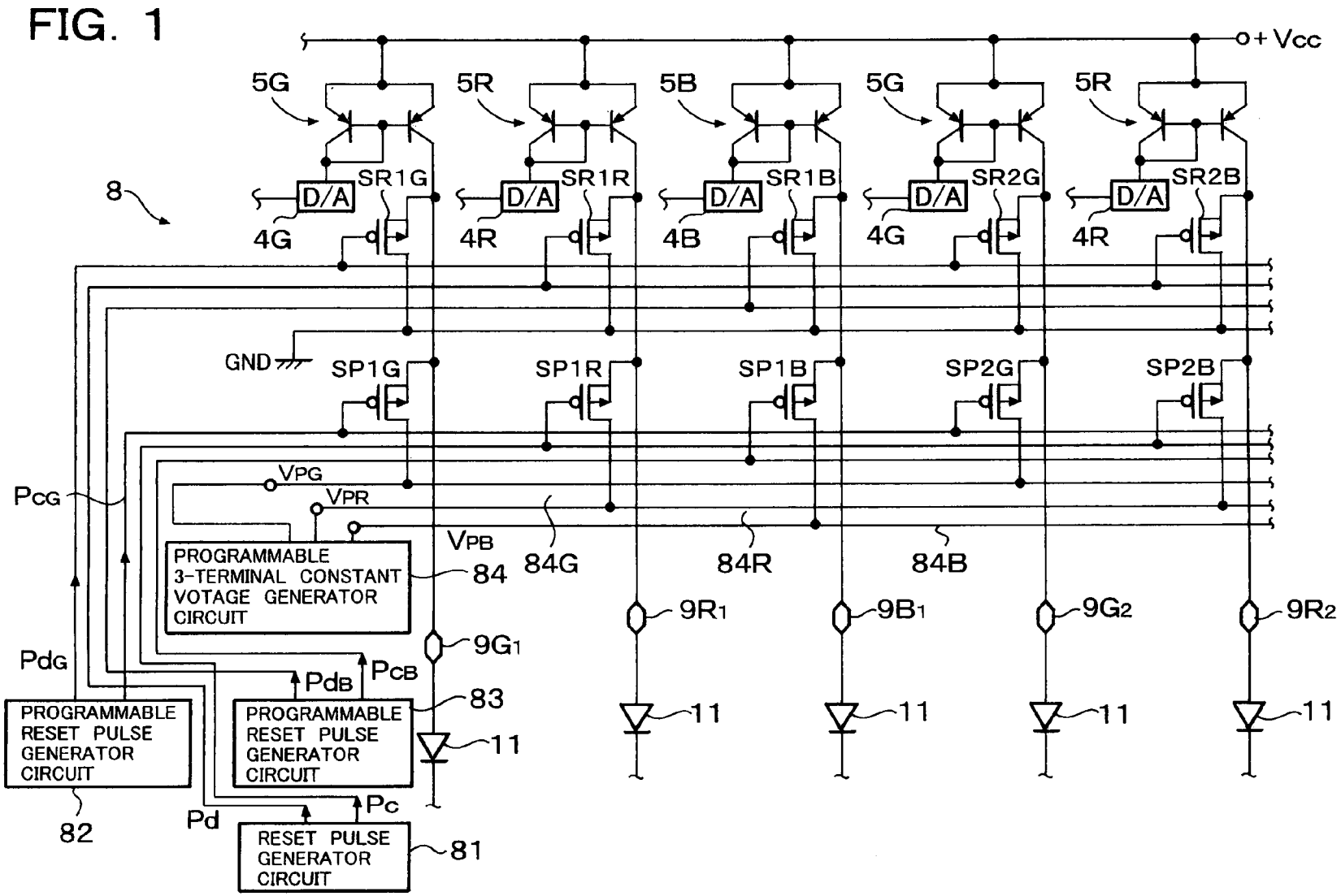
FIG. 1 is a block circuit diagram of an organic EL drive circuit of an organic EL panel, according to an embodiment of the present invention.

FIG. 1 shows the relation between the column driver 10 and a terminal voltage reset circuit 8 of the organic EL element.

In FIG. 1, the D/A converter circuits 4G for G color and the D/A converter circuits 4B for B color correspond to the D/A converter circuits 4R shown in FIG. 2, respectively. Similarly, output stage current sources 5G for G color correspond to the output stage current sources 5R for R color shown in FIG. 2, respectively. Column pins 9G1, 9R1, 9B1, 9G2, 9R2, 9B2, . . . , 9Gm, 9Rm, 9Bm are output terminals of the column driver 10. Incidentally, the column pins 9R1 to 9Rm correspond to the output terminals X1 to Xm shown in FIG. 2. The column pins are connected to anodes of organic EL elements 11 having cathodes connected to a row side scan circuit (not shown).

The terminal voltage reset circuit 8 functions to reset the terminal voltages at the anodes of the organic EL elements to a constant voltage. The terminal voltage reset circuit 8 includes a reset pulse generator circuit 81, programmable reset pulse generator circuits 82 and 83 for generating reset pulses having programmable widths, a programmable 3-terminal constant voltage generator circuit 84 for generating programmable constant voltages VPR, VPG and VPB corresponding to the respective R, G and B display colors, reset switch circuits SR1G, SR1R, SR1B, . . . , SRmG, SRmR, SRmB and precharge switch circuits SP1G, SP1R, SP1B, . . . , SPmG, SPmR, SPmB. The constant-voltages VPR, VPG and VPB satisfy conditions VPG<VPR and VPB<VPR.

The reset pulse generator circuit 81 generates a discharge pulse Pd and a precharge pulse Pc within the resetting period T, the programmable reset pulse generator circuits 82 generates a discharge pulse PdG and a precharge pulse PcB within the resetting period T and the programmable reset pulse generator circuits 83 generates a discharge pulse PdB and a precharge pulse PcB within the resetting period T.

The programmable 3-terminal constant voltage generator circuit 84 is constructed with three 3-terminal constant voltage regulators and three D/As provided corresponding to respective R, G and B display colors. The 3-terminal constant voltage regulators generate the respective constant voltages VPR, VPG and VPB by receiving voltages form D/As, respectively.

The constant voltages VPR, VPG and VPB generated by the programmable 3-terminal constant voltage generator circuit 84 can be varied according to a voltage data set in the MPU, etc., which is provided in the programmable 3-terminal constant voltage generator circuit 84, and the regulation of these constant voltages can be done later correspondingly to the voltage data. Further, since an active current supply is possible by using the 3-terminal regulator having a amplifier, it is possible to generate large precharge current to thereby shorten the precharge period correspondingly to the increase of the precharge current.

Incidentally, the data to be set in the programmable 3-terminal constant voltage generator circuit 84 is stored in a non-volatile memory, etc., of the MPU and is set in the programmable 3-terminal constant voltage generator circuit 84 when the power source thereof is turned ON. Such data is stored in the non-volatile memory according to an input data from the external MPU. Particularly, it is preferable to regulate white balance by performing the data input to the MPU and the data write in the non-volatile memory through a key board at a test stage in a shipping of product.

One ends of all of the reset switch circuits SR1G, SR1R, SR1B, . . . SRmG, SRmR, SRmB are grounded. The other ends of the reset switch circuits SR1G, SR2G, SR3G, . . . SRmG for G display color are connected to the column pins 9G1, 9G2, . . . , 9Gm for G color, respectively. The other ends of the reset switch circuits SR1R, SR2R, SR3R, . . . SRmR for R color are connected to the column pins 9R1, 9R2, . . . , 9Rm for R color, respectively. Similarly, the other ends of the reset switch circuits SR1B, SR2B, SR3B, . . . SRmB for B color are connected to the column pins 9B1, 9B2, . . . , 9Bm for B color, respectively.

One ends of the precharge switch circuits SP1G, SP2G, SP3G, . . . , SPmG for G color are connected to a voltage line 84G, which is at the constant voltage VPG, of the programmable 3-terminal constant voltage generator circuit 84 and the other ends thereof are connected to the column pins 9G1, 9G2, . . . , 9Gm for G color, respectively. One ends of the precharge switch circuits SP1R, SP2R, SP3R, . . . , SPmR for R color are connected to a voltage line 84R, which is the constant voltage VPR, of the programmable 3-terminal constant voltage generator circuit 84 and the other ends thereof are connected to the column pins 9R1, 9R2, . . . , 9Rm for R color, respectively. One ends of the precharge switch circuits SP1B, SP2B, SP3B, . . . , SPmB for B color are connected to a voltage line 84B, which is the constant voltage VPB, of the programmable 3-terminal constant voltage generator circuit 84 and the other ends thereof are connected to the column pins 9B1, 9B2, . . . , 9Bm for B color, respectively.

The reset pulse generator circuit 81 supplies the display pulse Pd to the reset switch circuits SR1R, . . . , SRmR for R color and the precharge pulse Pc to the precharge switch circuits SP1R, SP2R, . . . , SPmR for R color. The programmable reset pulse generator circuit 82 supplies the display pulse PdG to the reset switch circuits SR1G, . . . , SRmG for G color and the precharge pulse PcG to the precharge switch circuits SP1G, SP2G, . . . , SPmG for G color and the programmable reset pulse generator circuit 83 supplies the display pulse PdB to the reset switch circuits SR1B, . . . , SRmB for B color and the precharge pulse PcB to the precharge switch circuits SP1B, SP2B, . . . , SPmB for B color.

These switch circuits are ON in the time periods corresponding to widths of the discharge pulse and the precharge pulse.

In reset time period (the time period C+the resetting period T) corresponding to a retrace period and the display period D, which are shown in FIG. 3(*a*), the pulse width of the discharge pulse Pd for R color corresponds to the discharge period td and the reset switch circuits SR1R, SR2R, . . . , SRmR are ON during the discharge pulse Pd. The remaining period (T−td) corresponds to the width of the precharge pulse Pc and the precharge switch circuits SP1R, . . . , SPmR are ON during the period (T−td).

As a result, the anode terminal of the organic EL element is set to the precharge voltage VPR after the anode terminal is grounded once.

On the other hand, the pulse width of the discharge pulse PdG for G color corresponds to the discharge period tg and the reset switch circuits SR1G, SR2G, . . . , SRmG are ON during the discharge pulse Pd. The remaining period (T−tg) corresponds to the width of the precharge pulse PcG, where tg>td.

As a result, the precharge voltage VPG or a predetermined voltage, which is determined by the precharge period (T−tg) and lower than the precharge voltage, is determined, after the anode of the organic EL element is grounded as shown in FIG. 3(*e*). The precharge voltage VPG is lower than the precharge voltage VPR.

The pulse width of the discharge pulse PdB for B color corresponds to the discharge period tb and the reset switch circuits SR1B, SR2B, . . . , SRmB are ON during the discharge pulse PdB. The remaining period (T−tb) corresponds to the width of the precharge pulse PcB and the precharge switch circuits SP1B, . . . , SPmB are ON during the period (T−tb).

As a result, the precharge voltage VPB or a predetermined voltage, which is determined by the precharge period (T−tb) and lower than the precharge voltage, is determined after the anode of the organic EL element is grounded, as shown in FIG. 3(*f*). The precharge voltage VPB is lower than the precharge voltage VPR. Since, as mentioned above, the precharge voltage for B or G color is lower than that for R color, the rising of the peak current for B or G color is delayed with respect to that for R color. Therefore, the light emission period for B or G color becomes shorter than that for R color, so that it is possible to lower luminous intensity of G or B color when the light emitting efficiency of the organic EL element for G or B color is higher than that for R color. As a result, it is possible to make luminous intensity for G or B color close to that for R color and, therefore, white balance regulation based on luminous intensities for R, G and B display colors becomes easy even when the dynamic ranges of reference currents for R, G and B colors are small.

As described hereinbefore, the programmable 3-terminal constant voltage generation circuit 84 of the organic EL drive circuit according to the present invention, is constructed with three programmable regulators. However, the programmable 3-terminal constant voltage generation circuit 84 may be constructed with a single programmable 3-terminal regulator to make the precharge voltages for R, G and B display colors equal. In such case, the drive current waveform shown in FIG. 3(*a*) is used.

Although the discharge pulses and the precharge pulses for G and B display colors are generated by providing the independent circuits, it is possible to control the discharge pulses and the precharge pulses by providing a single programmable constant voltage generator circuit since the difference in light emission efficiency between G and B display colors, which depends upon G and B luminescent materials, is small so far.

Further, depending upon the light emission efficiency of R color, the constant voltage VPR with which the precharge voltage for R color is determined may be set to a high voltage value with which the organic EL element does not emit light.

Further, the programmable 3-terminal constant voltage generator circuit 84 may be a mere constant voltage generator circuit.

Incidentally, since the terminal pins of the organic EL panel and the output pins of the column driver IC connected to these terminal pins are integrated naturally, these terminals are not described separately in this specification and attached claims.

What is claimed is:

1. An organic EL panel drive circuit for current-driving an organic EL panel through terminal pins thereof, which are provided correspondingly to R, G and B display colors, comprising:

at least three first switch circuits provided correspondingly to said terminal pins for R, G and B display colors and connected between said terminal pins and a first potential line at a first potential, for discharging residual chargers of organic EL elements having anodes connected to said terminal pins;

at least three second switch circuits provided correspondingly to said terminal pins for R, G and B display colors and connected between said terminals and a second potential line at a second potential, for setting said anodes of said organic EL elements to predetermined potentials lower than light emission potentials of said EL elements; and a pulse generator circuit for generating pulses for turning said first switch circuits ON and then turning the first switch circuits OFF and then turning the second switch circuits ON during a precharge period within a predetermined time period, respectively.

2. The organic EL panel drive circuit as claimed in claim 1, wherein the predetermined time period is a resetting period, said pulses generated by said pulse generator circuit reset said organic EL elements to a constant voltage determined by said second potential and said first potential is lower than said second potential.

3. The organic EL panel drive circuit as claimed in claim 2, wherein each said pulse generated by said pulse generator circuit is composed of a first pulse and a second pulse, said first pulse functions to turn said first switch circuit ON and then OFF, said second pulse functions to turn said second switch circuit ON and then OFF in the resetting period, said first potential is ground potential and said second potential line is at a potential higher than ground potential.

4. The organic EL panel drive circuit as claimed in claim 3, wherein said resetting period has a discharge period and a precharge period for resetting the organic EL element to the constant voltage, a width of said first pulse corresponds to the discharge period and a width of said second pulse corresponds to the precharge period.

5. The organic EL panel drive circuit as claimed in claim 4, wherein said second potential line includes a potential line for R display color and a potential line for G or B display color, the potential of said second potential line for R display color is different from the potential of said second potential line for G or B display color.

6. The organic EL panel drive circuit as claimed in claim 5, further comprising a programmable voltage generator circuit for generating a programmable voltage corresponding to the potential of said second potential line for R or G or B display color, wherein the second potential for R display color and the second potentials for G and B display colors are different.

7. The organic EL panel drive circuit as claimed in claim 6, wherein said pulses generated by said pulse generator circuit are provided correspondingly to respective R, G and B display colors and the second potentials for R, G and B display colors are different.

8. The organic EL panel drive circuit as claimed in claim 6, wherein said pulse generator circuit sets said anodes to ground potential once by turning said first switch circuits ON by said first pulse, said width of said first pulse for R display color is less than said width of said first pulse for each of G and B display colors and said predetermined potential of said organic EL element for each of G and B display colors is lower than said predetermined potential of the organic EL element for R display color.

9. The organic EL panel drive circuit as claimed in claim 7, wherein said pulse generator circuit has a programmable pulse generator circuit for making the width of said pulse selectable and said width of said second pulse for R display color is larger than said width of said second pulse for each of G and B display colors.

10. An organic EL panel drive circuit for current-driving an organic EL panel through terminal pins thereof, which are provided correspondingly to R, G and B display colors, comprising:

at least three first switch circuits and provided correspondingly to said terminal pins for R, G and B display colors and connected between said terminal pins and a first potential line at a first potential, for discharging residual chargers of organic EL elements having anodes connected to said terminal pins;

at least three second switch circuits provided correspondingly to said terminal pins for R, G and B display colors and connected between said terminals and a second potential line at a second potential, for setting said anodes of said organic EL elements to predetermined potentials lower than light emission potentials of said EL elements; and a pulse generator circuit for generating pulses for turning said first switch circuits ON and then turning the first switch circuits OFF and then turning the second switch circuits ON during a precharge period within a predetermined time period, respectively, said pulses generated by said pulse generator circuit having widths, with which said predetermined potentials for at least two of the R, G and B display colors are made different, in order to regulate luminous intensities of R, G and B display colors for regulation of white balance.

11. The organic EL panel drive circuit as claimed in claim 10, wherein said predetermined time period is a resetting period, said pulses generated by said pulse generator circuit reset said organic EL elements to a constant voltage determined by said second potential and the potential of said first potential line is lower than the potential of said second potential line.

12. The organic EL panel drive circuit as claimed in claim 11, wherein each said pulses generated by said pulse generator circuit is composed of a first pulse and a second pulse, said first pulse functions to turn said first switch circuit ON and then OFF, said second pulse functions to turn said second switch circuit ON and then OFF in the resetting period, said first potential line is at ground potential and said second potential line is at potential higher than ground potential.

13. The organic EL panel drive circuit as claimed in claim 12, wherein said resetting period has a discharge period and a precharge period for resetting the organic EL element to the constant voltage, a width of said first pulse corresponds to the discharge period and a width of said second pulse corresponds to the precharge period.

14. The organic EL panel drive circuit claimed in claim 13, wherein said second potential line includes a potential line for R display color and a potential line for G or B display color, a potential of said potential line for R display color of said second potential line and a potential of said potential line for G or B display color of said second potential line are made different.

15. The organic EL panel drive circuit as claimed in claim 14, wherein said pulse generator circuit sets said anodes of said organic EL elements to ground potential once by turning said first switch circuit ON by said first pulse, said width of said first pulse for R display color is less than said width of said first pulse for each of G and B display colors and said predetermined potential of said organic EL elements for each of G and B display colors is lower than said predetermined potential of said organic EL elements for R display color.

16. The organic EL panel drive circuit as claimed in claim 15, further comprising a reference current generator circuit and a reference current forming circuit provided for each of the R, G and B display colors, wherein said second potential line is provided for each of the R, G and B display colors, said reference current forming circuits are responsive to reference currents generated by said reference current generator circuits and externally set data to form currents having values corresponding to the externally set data as drive currents to be supplied to said terminal pins or currents, which are bases of the drive currents and values of said drive currents generated by said reference current forming circuit are set correspondingly to the respective R, G and B display colors in order to perform luminance regulation to thereby obtain white balance.

17. An organic EL display device for current-driving an organic EL panel through terminal pins thereof, which are provided correspondingly to R, G and B display colors, comprising:

at least three first switch circuits provided correspondingly to said terminal pins for R, G and B display colors and connected between said terminal pins and a first potential line, for discharging residual chargers of organic EL elements having anodes connected to said terminal pins;

at least three second switch circuits provided correspondingly to said terminal pins for R, G and B display colors and connected between said terminals and a second potential line, for setting said anodes of said organic EL elements to predetermined potentials lower than light emission potentials of said EL elements; and a pulse generator circuit for generating pulses for turning said first switch circuits ON and then turning the first switch circuits OFF and then turning the second switch circuits ON during a precharge period within a predetermined time period, respectively.

18. The organic EL display device as claimed in claim 17, wherein the predetermined time period is a resetting period, said pulses generated by said pulse generator circuit reset said organic EL elements to a constant voltage determined by said second potential and the potential of said first potential line is lower than the potential of said second potential line.

19. The organic EL display device as claimed in claim 18, wherein each said pulse generated by said pulse generator circuit is composed of a first pulse and a second pulse, said first pulse functions to turn said first switch circuit ON and then OFF, said second pulse functions to turn said second switch circuit ON and then OFF in the resetting period, said first potential line is at ground potential and said second potential line is at a potential higher than ground potential.

20. The organic EL display device as claimed in claim 19, wherein said resetting period has a discharge period and a precharge period for resetting the organic EL element to the constant voltage, a width of said first pulse corresponds to the discharge period and a width of said second pulse corresponds to the precharge period.

21. The organic EL display device as claimed in claim 20, wherein said second potential line includes a potential line for R display color and a potential line for G or B display color, a potential of said potential line for R display color of said second potential line and a potential of said potential line for G or B display color of said second potential line are different.

22. An organic EL display device for current-driving an organic EL panel through terminal pins thereof, which are provided correspondingly to respective R, G and B display colors, comprising:

at least three first switch circuits provided correspondingly to said terminal pins for R, G and B display colors and connected between said terminal pins and a first potential line, for discharging residual chargers of organic EL elements having anodes connected to said terminal pins;

at least three second switch circuits provided correspondingly to said terminal pins for R, G and B display colors and connected between said terminals and a second potential line, for setting said anodes of said organic EL elements to predetermined potentials lower than light emission potentials of said EL elements; and a pulse generator circuit for generating pulses for turning said first switch circuits ON and then turning the first switch circuits OFF and then turning the second switch circuits ON during a precharge period within a predetermined time period, respectively, said pulse generator circuit generating said pulses having widths, with which said predetermined potentials for at least two of the R, G and B display colors are made different, in order to regulate luminous intensities of R, G and B display colors for regulation of white balance.

23. The organic EL display device as claimed in claim 22, wherein said predetermined time period is a resetting period having a discharge period and a precharge period for resetting the organic EL element to the constant voltage, said pulses generated by said pulse generator circuit reset said organic EL elements to a constant voltage determined by said second potential and the potential of said first potential line is lower than the potential of said second potential line.

24. The organic EL display device as claimed in claim 23, wherein each said pulse generated by said pulse generator circuit is composed of a first pulse and a second pulse, said first pulse has a first width for turning said first switch circuits ON and then OFF correspondingly to the discharge period, said second pulse has a second width for turning said second switch circuits ON and then OFF in the resetting period correspondingly to the precharge period, said first potential line is at ground potential and said second potential line is at a potential higher than ground potential.

* * * * *